United States Patent [19]

Redifer

[11] 4,136,491

[45] Jan. 30, 1979

[54] FLOOR SANDING MACHINE WITH CONTROLLABLE MOTION

[76] Inventor: William H. Redifer, 116 Maywood Dr., Youngstown, Ohio 44512

[21] Appl. No.: 775,793

[22] Filed: Mar. 9, 1977

[51] Int. Cl.[2] ..... B24B 23/02

[52] U.S. Cl. ..... 51/177; 15/49 C

[58] Field of Search ..... 51/177; 15/49 R, 49 C, 15/50 R, 50 C, 98, 385; 299/41

[56] References Cited

U.S. PATENT DOCUMENTS

| | | | |
|---|---|---|---|
| 1,961,384 | 6/1934 | Oelmann | 15/49 R |
| 2,978,719 | 4/1961 | Arones | 15/49 R |
| 3,398,490 | 8/1968 | Redifer | 51/177 |
| 3,496,681 | 2/1970 | Oswald | 51/177 |

*Primary Examiner*—Harold D. Whitehead
*Assistant Examiner*—Roscoe V. Parker
*Attorney, Agent, or Firm*—Webster B. Harpman

[57] ABSTRACT

A floor sanding machine is provided with a pair of sanding discs, each of which is driven by an individual variable speed electric motor. Individual controls on the handle of the floor sanding machine control the speed of each of the individual motors so that the sanding machine can be guided in a desired direction by changing the speed of one or the other or both of the electric motors.

5 Claims, 4 Drawing Figures

FLOOR SANDING MACHINE WITH CONTROLLABLE MOTION

BACKGROUND OF THE INVENTION (1) Field of the Invention

This invention relates to floor sanding machines such as are used for resurfacing floors and polishing, buffing, waxing and cleaning floors and the like.

(2) Description of the Prior Art

Prior floor sanding machines have generally included sanding discs and are not controllable as to direction. A controllable sanding machine using multiple discs is seen in my U.S. Pat. No. 3,398,490. U.S. Pat. Nos. 1,961,384 and 2,978,719 are typical of the prior art devices. U.S. Pat. No. 3,496,681 shows two polishing wheels driven by two motors but provides no means for varying the speed of the motors so that the device is not controllable as to direction.

This invention enables an operator to guide the floor sanding machine in a straight path or guide it to right or left as desired by varying the speed of the individual motors driving the individual sanding or polishing discs of the machine by simply rotating the appropriate handles on the machine which operate the variable controls of the electric motors.

SUMMARY OF THE INVENTION

A floor sanding machine incorporates a pair of sanding or polishing discs, each of which is driven by an individual electric motor and each of the electric motors are individually controlled by control devices located on the handle of the floor polishing machine so that the operator can readily control the direction of the machine by varying the speed of one or the other or both of the electric motors.

DESCRIPTION OF THE PREFERRED EMBODIMENT

Figure 1:
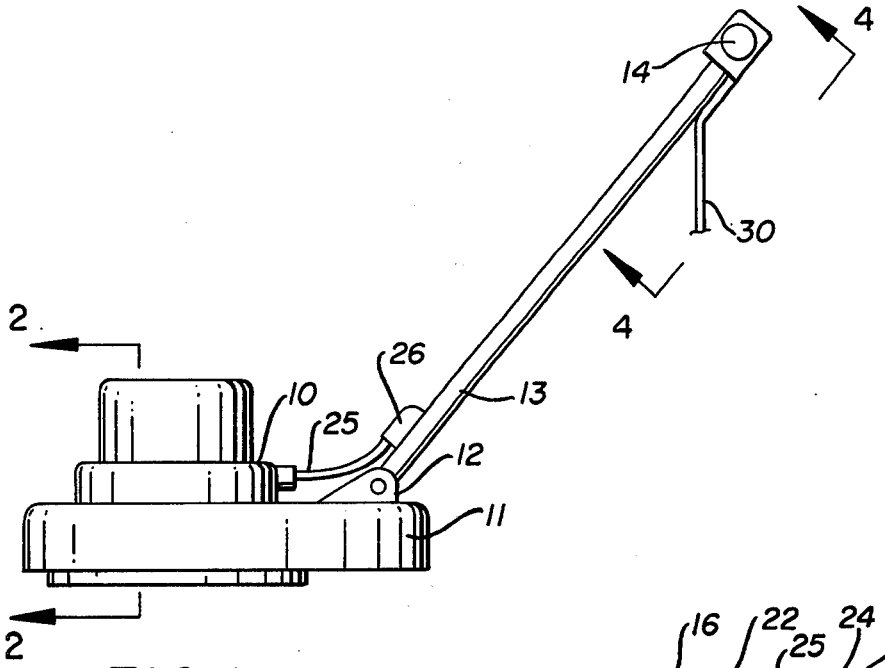
FIG. 1 is a side elevation of the floor sanding machine.
Figure 2:
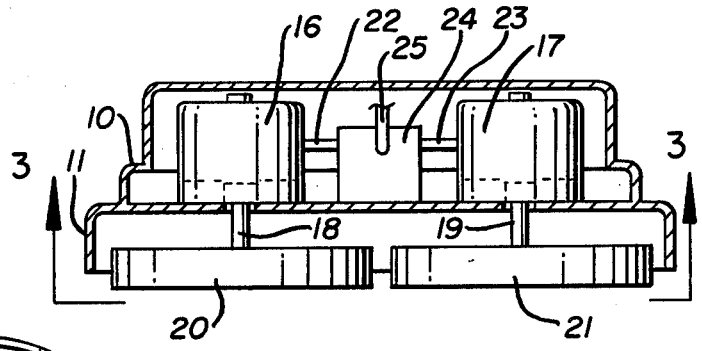
FIG. 2 is a vertical section on line 2–2 of FIG. 1.
Figure 3:
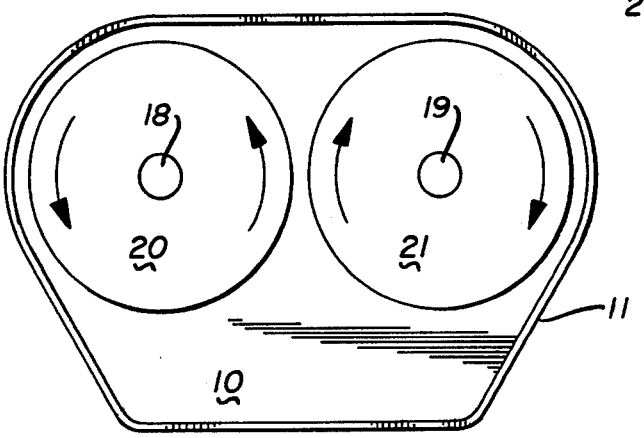
FIG. 3 is a bottom view on line 3–3 of FIG. 2.
Figure 4:
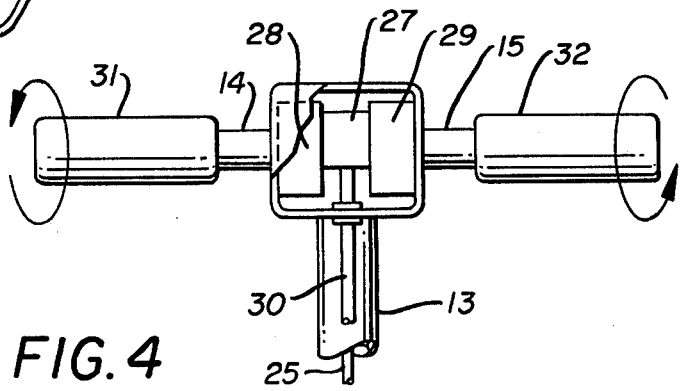
FIG. 4 is a detail of the handle and control means on line 4–4 of FIG. 1.

In the form of the invention chosen for illustration and description herein the floor sanding machine comprising a housing 10 with an enlarged lower area defined by an annular depending flange 11. A bracket 12 on the housing mounts a handle 13 and the upper end of the handle 13 is provided with oppositely disposed sidewardly extending control handles 14 and 15 as best seen in FIGS. 1 and 4 of the drawings. The housing 10 encloses a pair of electric motors 16 and 17 as best seen in FIG. 2 of the drawings and each of these electric motors drives an individual shaft 18 and 19 which are in turn coupled to discs 20 and 21 which may be detachable sanding discs, polishing discs, polishing brushes or waxing brushes as will occur to those skilled in the art. The electric motors are mounted on a supporting structure forming part of the housing 10.

The electric motors 16 and 17 are of the variable speed type and conductors for supplying electrical energy thereto are enclosed in conduits 22 and 23 which extend from each of the electric motors 16 and 17 to a junction box 24 located within the housing 10, and on the supporting structure therein. A multiple conductor cable 25 extends from the junction box 24 outwardly of the housing 10 and enters the handle 13 to a secondary junction box 27, which is mounted between a pair of manually operable variable voltage solid state control devices 28 and 29 which act to change the electrical current being supplied the electric motors 16 and 17 so as to speed them up or slow them down. A power supply cord 30 extends from the secondary junction box 27 and takes the form of an electrical extension cord by which the floor sanding machine of the invention can be connected to a suitable power source.

Still referring to FIG. 4 of the drawings, it will be seen that each of the manually operable current control devices is arranged to be actued by rotatable sleeves 31 and 32 which are mounted on the handles 14 and 15 heretofore referred to. The rotatable sleeves 31 and 32 rotate rods within the handles 14 and 15 and extending into the manually operated current control devices 28 and 29 so that the current supplied each of the electric motors 16 and 17 may be varied individually by rotating the rotatable sleeves 31 and 32 as will occur to those skilled in the art.

It will thus be seen that when the floor sanding machine of the invention is to proceed in a straight path, the electric motors are controlled so as to run at the same or at approximately the same speed and the revolving discs 20 and 21 will not introduce sideward deflection.

When it is desired to turn the machine to either side, the rotatable sleeves 31 and 32 are rotated accordingly and the change of speed of the electric motors and the speed of the revolving discs 20 and 21 will then urge the machine either to the right or left as the case may be, under the full control of the operator.

It will thus be seen that a floor sanding machine with individually controllable variable speed electric motors driving individual sanding discs or the like has been dislosed which will enable an operator to completely and easily control the direction of the sanding machine.

Although but one embodiment of the present invention has been illustrated and described, it will be apparent to those skilled in the art that various changes and modifications may be made therein without departing from the spirit of the invention and having thus described my invention what I claim is:

1. In a floor sanding machine having a housing and a supporting structure therein, a pair of electric motors on said supporting structure in side by side relation, drive shafts on said motors extending downwardly from said supporting structure and housing and a pair of discs on said drive shafts, means for varying the speed of said electric motors individually, a handle on said floor sanding machine extending at a right angle to a line intersecting said drive shafts of said electric motors, individual control means on said handle and secondary means interconnecting said individual control means and said means for varying the speed of said electric motors and a power source for said electric motors whereby manual operation of said individual control means varies the speeds of said individual electric motors and the discs driven thereby so as to cause the sanding machine to move to the right or left of a path on which the floor machine is traveling.

2. The floor sanding machine of claim 1 and wherein said discs are sanding discs.

3. The floor sanding machine of claim 1 and wherein said discs are positioned partially below said housing.

4. The floor sanding machine of claim 1 and wherein said handle has oppositely disposed outwardly extending hand grip portions, rotatable sleeves on said grip portions, said sleeves defining said individual control means so as to operate the same when revolved.

5. The floor sanding machine of claim 1 and wherein said means for varying the speed of said electric motors are solid state variable voltage control devices.

* * * * *